US005615986A

United States Patent [19]

Cox

[11] Patent Number: 5,615,986

[45] Date of Patent: Apr. 1, 1997

[54] BINDING MACHINES

[75] Inventor: Scott Cox, Warwick, United Kingdom

[73] Assignee: Acco-Rexel Group Services Plc., United Kingdom

[21] Appl. No.: 356,337

[22] PCT Filed: Nov. 26, 1992

[86] PCT No.: PCT/GB92/02193

§ 371 Date: Feb. 1, 1995

§ 102(e) Date: Feb. 1, 1995

[87] PCT Pub. No.: WO94/00302

PCT Pub. Date: Jan. 6, 1994

[30] Foreign Application Priority Data

Jun. 24, 1992 [GB] United Kingdom ..... 9213447

[51] Int. Cl.[6] ..... B42B 5/10

[52] U.S. Cl. ..... 412/40

[58] Field of Search ..... 412/7, 38, 40

[56] References Cited

U.S. PATENT DOCUMENTS

| | | | |
|---|---|---|---|
| 3,122,761 | 3/1964 | Bouvier | 412/40 |
| 4,820,099 | 4/1989 | Battisti | 412/40 X |
| 4,872,796 | 10/1989 | Hsieh et al. . | |
| 5,431,519 | 7/1995 | Baumann | 412/40 |

FOREIGN PATENT DOCUMENTS

| | | | |
|---|---|---|---|
| 2448082 | 4/1976 | Germany . | |
| 1436870 | 5/1976 | United Kingdom | 412/40 |
| WO91/01224 | 2/1991 | WIPO . | |

*Primary Examiner*—S. Thomas Hughes

*Attorney, Agent, or Firm*—Kirschstein, et al.

[57] ABSTRACT

A binding machine is described for use in uncoiling the fingers of a binding comb (50), preparatory to an insertion of the fingers (54) of the comb into the apertures (48) provided in a packet or stack of sheets (46) to be bound together. The machine comprises a housing (6) supported for rectilinear reciprocal movement a drive plate (8), said drive plate being provided adjacent opposite side edges with a series of aperture (10), affording a rack, engageable by respective pinions (12) of the machine. The housing (6) is provided with a plurality of fixed abutment elements (28), a clamping member (16) being mounted on the housing for movement between a retracted position and an advanced position, in which advanced position clamping elements (18) of the clamping member are disposed closely adjacent to fixed abutment elements (28), to clamp the spine (52) of a binding comb therebetween. An operating member (36) is also mounted on the housing for movement between a retracted position and an advanced position, such movement of the operating member causing fingers (38) thereof to engage within the coiled fingers (54) of the binding comb, and causing them to be unwound allowing the fingers (54) to be inserted into the apertures (48) of the packet. Movement of the drive plate (8) from its rest position causes the clamping member (16) to be moved to its advanced position, and then the operating member (36) to its advanced position.

6 Claims, 7 Drawing Sheets

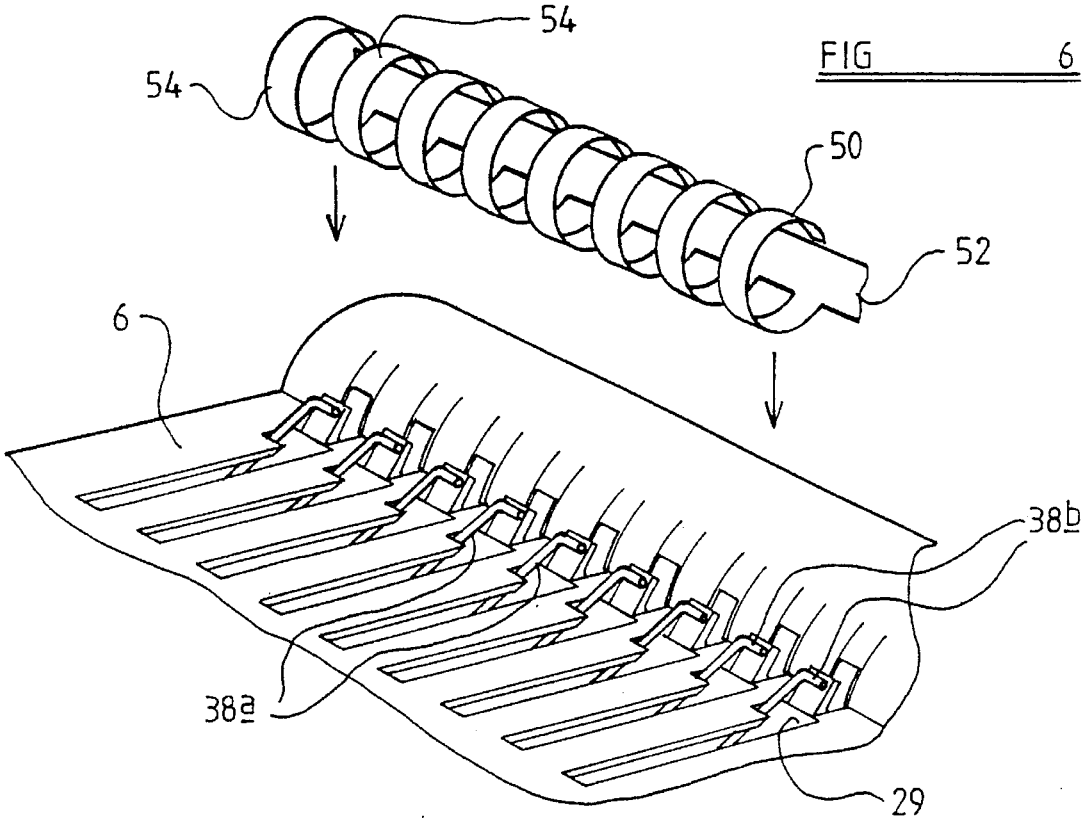
FIG 6
FIG 7
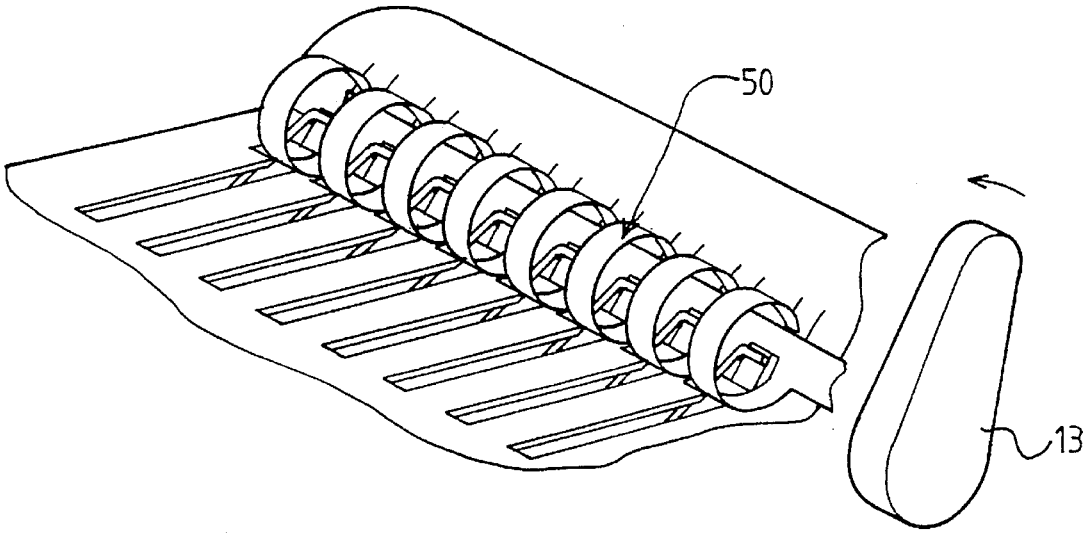

FIG 8
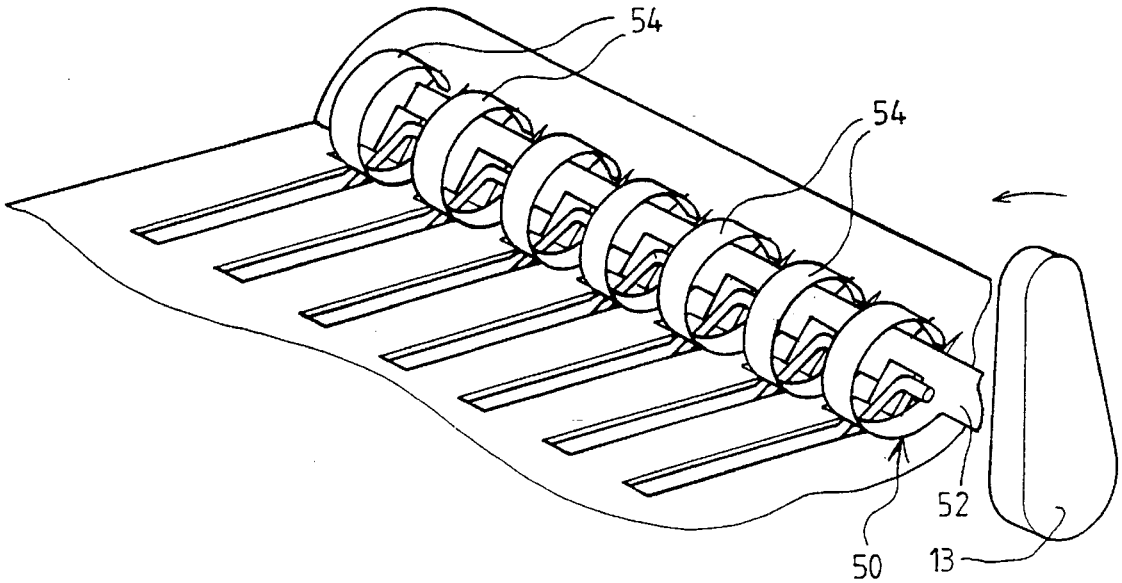
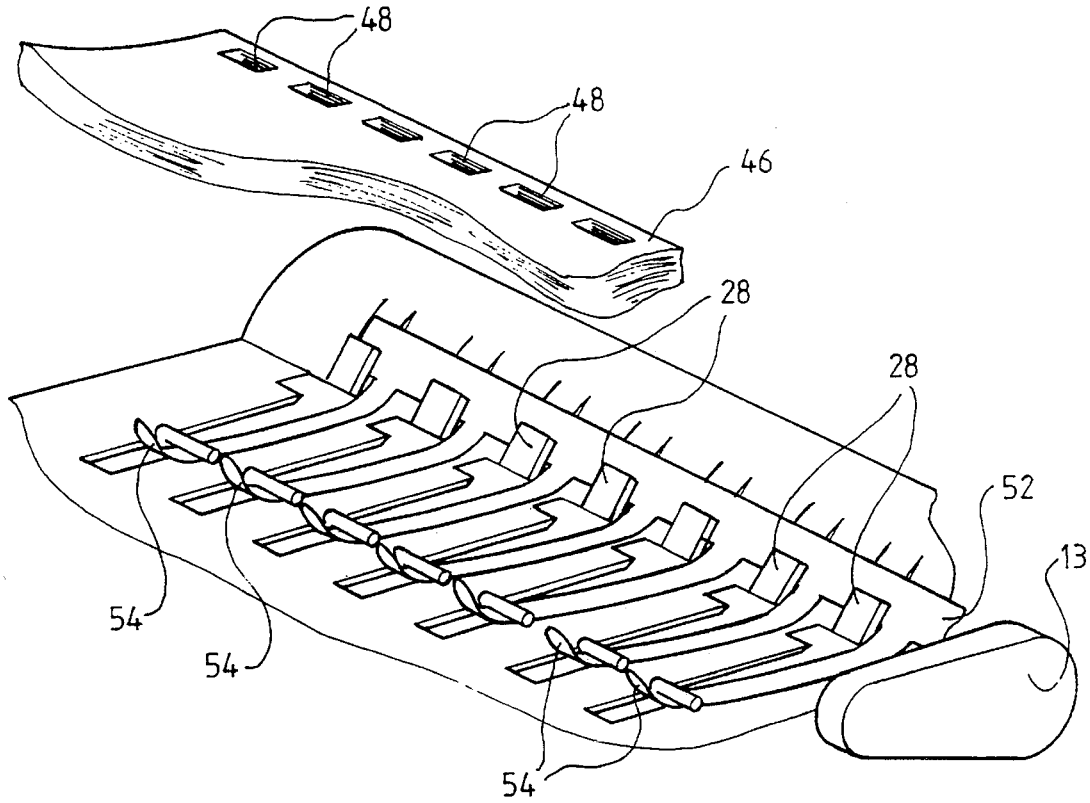
FIG 9

BINDING MACHINES

BACKGROUND OF THE INVENTION

This invention is concerned with improvements relating to binding machines, particularly of the kind (hereinafter referred to as being of the kind specified) for binding packets having a row of apertures or perforations adjacent to one side edge, by the use of and a binding element (conveniently termed a "comb") comprising a spine and a series of curved, flexible fingers which may be located in the apertures of the packet, to bind the sheets of the packet together into book-like form.

Difficulty is encountered in the provision of a machine of the kind specified, which will clamp the binding element in a convenient position, and straighten the fingers to allow them to be inserted into the apertures of a stack, during a binding operation.

SUMMARY OF THE INVENTION

According to this invention there is provided a binding machine of the kind specified comprising clamping a mechanism to clamp a binding element and an operating member operative to cause the fingers of the binding element to be uncoiled, the clamping mechanism being moved to an operative position prior to movement of the operating member to so uncoil the binding element.

Preferably the clamping mechanism is operative to clamp the binding element at a plurality of spaced positions, preferably said positions being spaced a distance equal to the spacing between the fingers of the binding element.

Preferably said clamping is effected under the action of a spring. Thus, advantageously, the clamping mechanism comprises clamping elements which are urged by the action of a spring into engagement with fixed abutment elements.

Preferably the operating and clamping mechanisms are moved by a single olive mechanism, such as a rack and pinion. Thus advantageously the machine comprises drive means to so effect movement of the operating and clamping mechanisms.

Preferably the operating member comprises a plurality of fingers, the operating member being so constructed and arranged that on movement of the operating member to an advanced position, said fingers move initially laterally to positions in which they engage within the coiled fingers of the binding element, and then longitudinally to unwind the coiled fingers, preparatory to insertion of the uncoiled fingers into the apertures of the packet to be bound.

According to this invention there is also provided a binding machine of the kind specified comprising a) a housing provided with a plurality of fixed abutment elements;

b) a clamping member mounted on the housing for movement between a retracted position and an advanced position, in which advanced position clamping elements of the clamping member are disposed closely adjacent to abutment elements;

c) a drive member linearly movable in a first direction to a rest position and in a second direction to an advanced position; and d) an operating member movable between a retracted position and an advanced position, wherein consequent upon movement of the drive member to its rest position the clamping member is moved to its retracted position and the operating member to its retracted position, and on movement of the drive member to its advanced position the clamping member is moved to its advanced position to clamp the binding element and the operating member to its advanced position, fingers of the operating member moving first laterally to a position adjacent to the fingers of the binding element, and then longitudinally to uncoil the fingers of the binding element.

Advantageously the operating member comprises a plurality of fingers, each finger comprising a longitudinal portion and a transverse portion, lateral movement of the operating member causing each of the transverse portions of the fingers to engage within a coiled finger of a binding element clamped by the clamping member, and longitudinal movement causing the transverse portion to unwind the coiled finger.

Advantageously, means is provided which is operative on initial movement of the drive member from its rest position to cause the operating member to move solely laterally, and further means operative subsequently to cause the operating member to move solely longitudinally.

BRIEF DESCRIPTION OF THE DRAWINGS

There will now be given a detailed description, to be read with reference to the accompanying drawings, of a binding machine which is a preferred embodiment of this invention, having been selected for the purposes of illustrating the invention by way of example.

In the accompanying drawings:

FIGS. 6 to 9 are perspective views showing various stages in the use of the machine.

DETAILED DESCRIPTION OF THE PREFERRED EMBODIMENT

The machine which is the preferred embodiment of the invention is specifically of the kind specified, being for use in the uncoiling of the fingers of the binding element, of the kind conveniently known as a binding comb, preparatory to an insertion of the fingers of the comb into the apertures provided in a packet or stack of sheets to be bound together.

Figure 1:
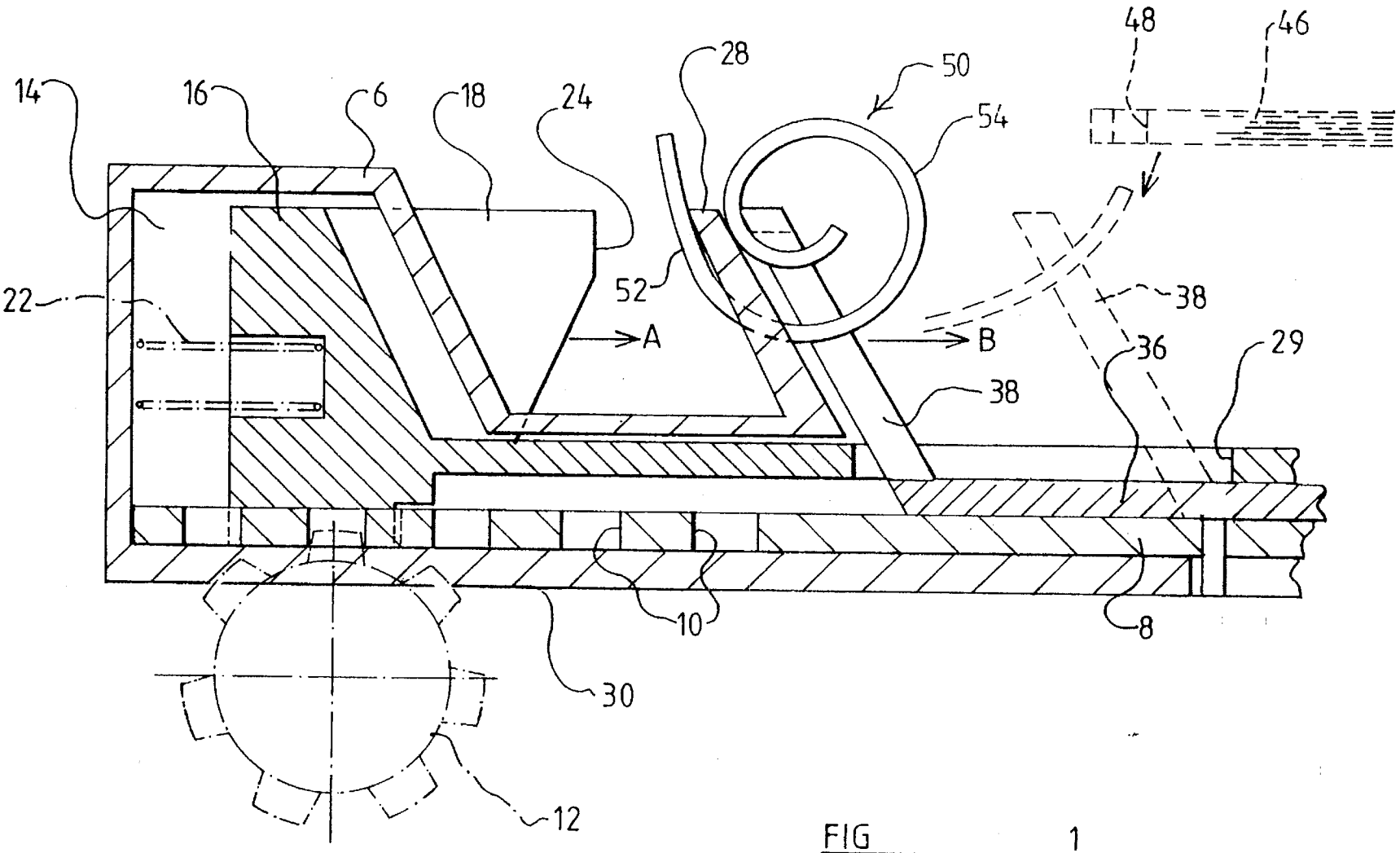
FIG. 1 is a vertical sectional view of part of the machine which is the preferred embodiment of the invention in a first, clamped position.

The machine comprises a housing 6 supporting for rectilinear reciprocal movement a drive member in the form of a drive plate 8, said drive plate being provided adjacent opposite edges with a series of apertures 10, affording a rack, engageable by respective pinions 12 of the machine, as will hereinafter be described. Mounted within an enclosure 14 of the housing is a clamping member 16, said clamping member comprising a plurality of clamping elements 18, each of which protrudes through a window or opening 20 of the enclosure 14 (see FIG. 2), the clamping member 16 being urged to a forward position by a number of spring means 22 acting between the housing and the clamping member 16, as is shown in FIG. 1. In said forward position clamping faces 24 of the elements 18 are disposed in close proximity to inclined abutment members 28 of the housing 6, to permit parts of a binding comb 50 to be clamped therebetween (see also FIG. 1).

Figure 4:
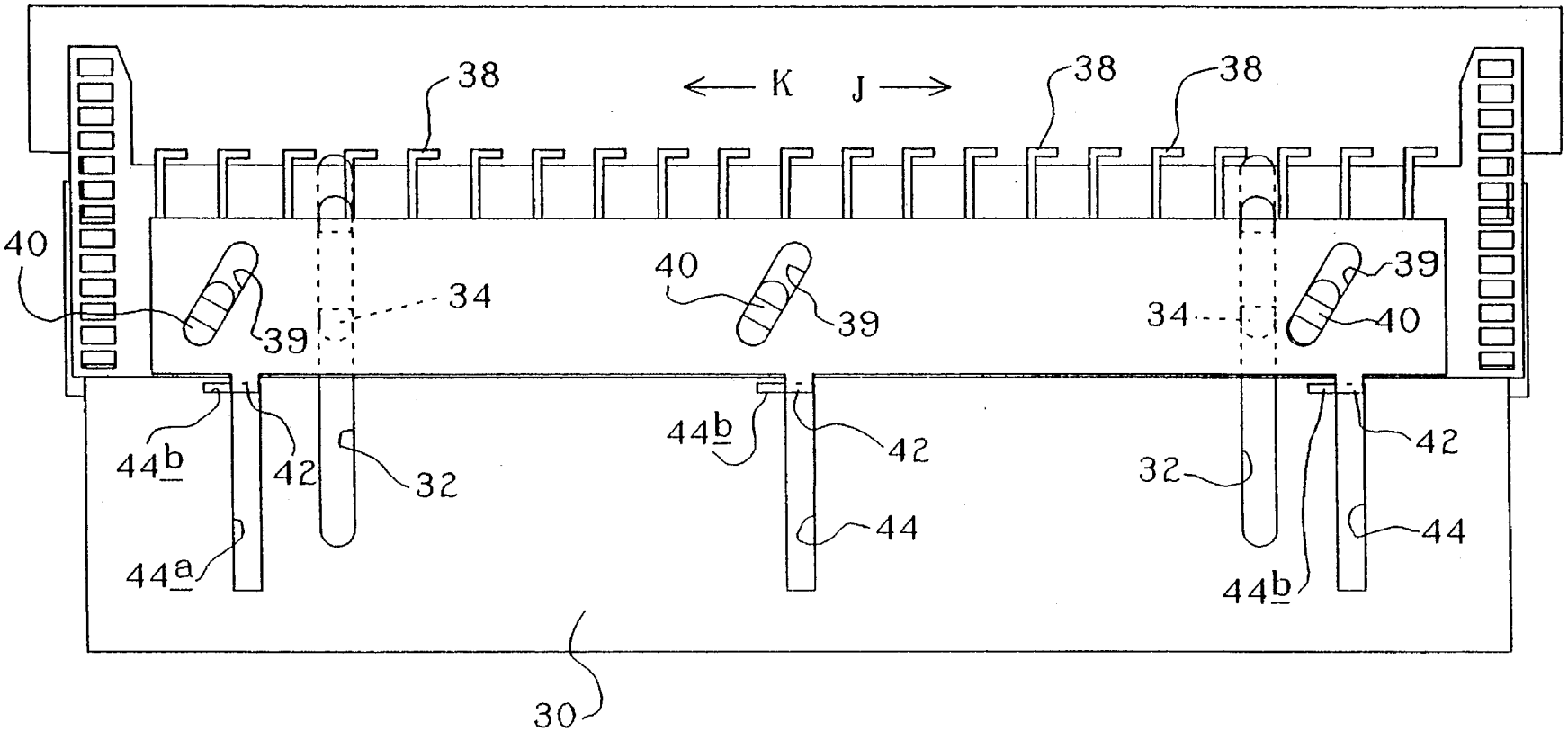

The housing also comprises a base plate 30 provided with two elongate slots 32, into which studs 34 of the drive member 8 extend, to ensure rectilinear movement of the drive member 8 over the base plate 30 (see FIG. 4).

Figure 5:
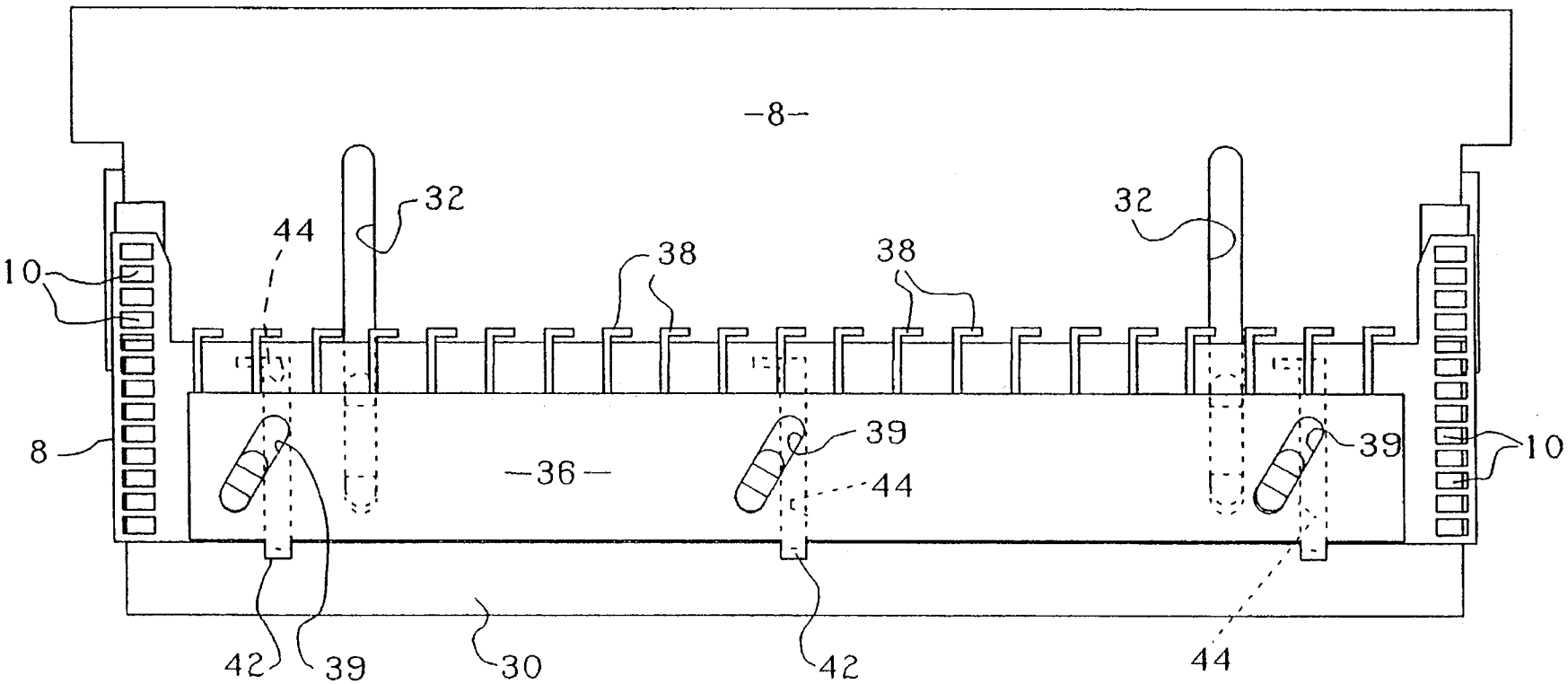

The machine also comprises an operating member 36 in the form of a flat plate slidable over the drive plate 8 and beneath a top plate 29 of the housing, the operating member 36 being provided at its forward end with a plurality of inclined fingers 38, each comprising a longitudinal portion 38*a* and a transverse portion 38*b* (FIG. 2), the fingers 38 extending through openings 29*a* of the plate 29, large enough to permit movement of the fingers. The operating member 36 is provided with three inclined, parallel guide slots 39, into which fixed studs 40 of the drive plate extend, whilst guiding members in the form of tangs 42 extending downwardly from a rear edge of the operating member extend into guide slots 44 of the base plate 30, said guide slots comprising a longitudinal section 44*a* and a short transverse section 44*b* (see FIGS. 3, 4 and 5).

Figure 2:
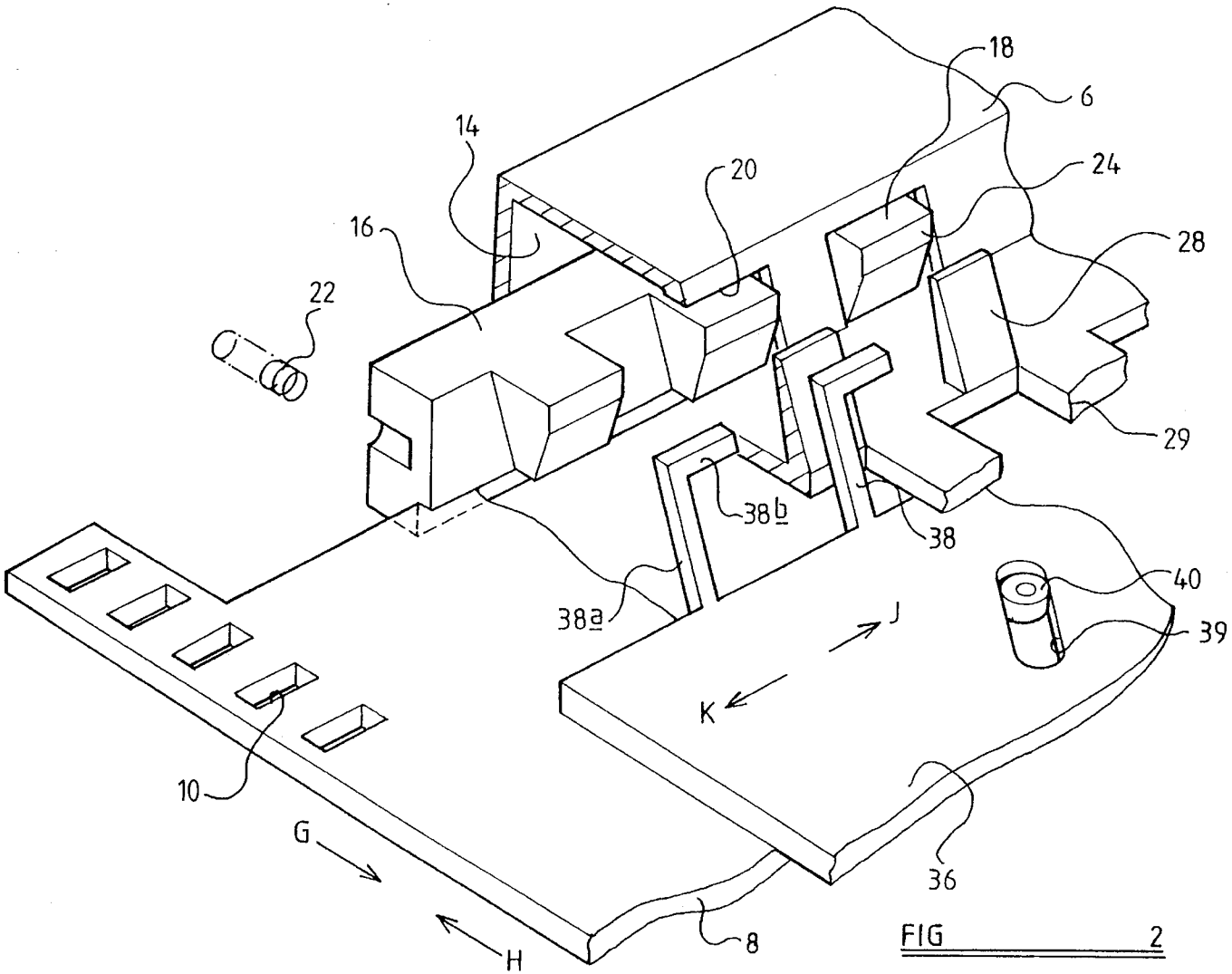
FIG. 2 is a schematic perspective view, parts having been removed for clarity.
Figure 3:
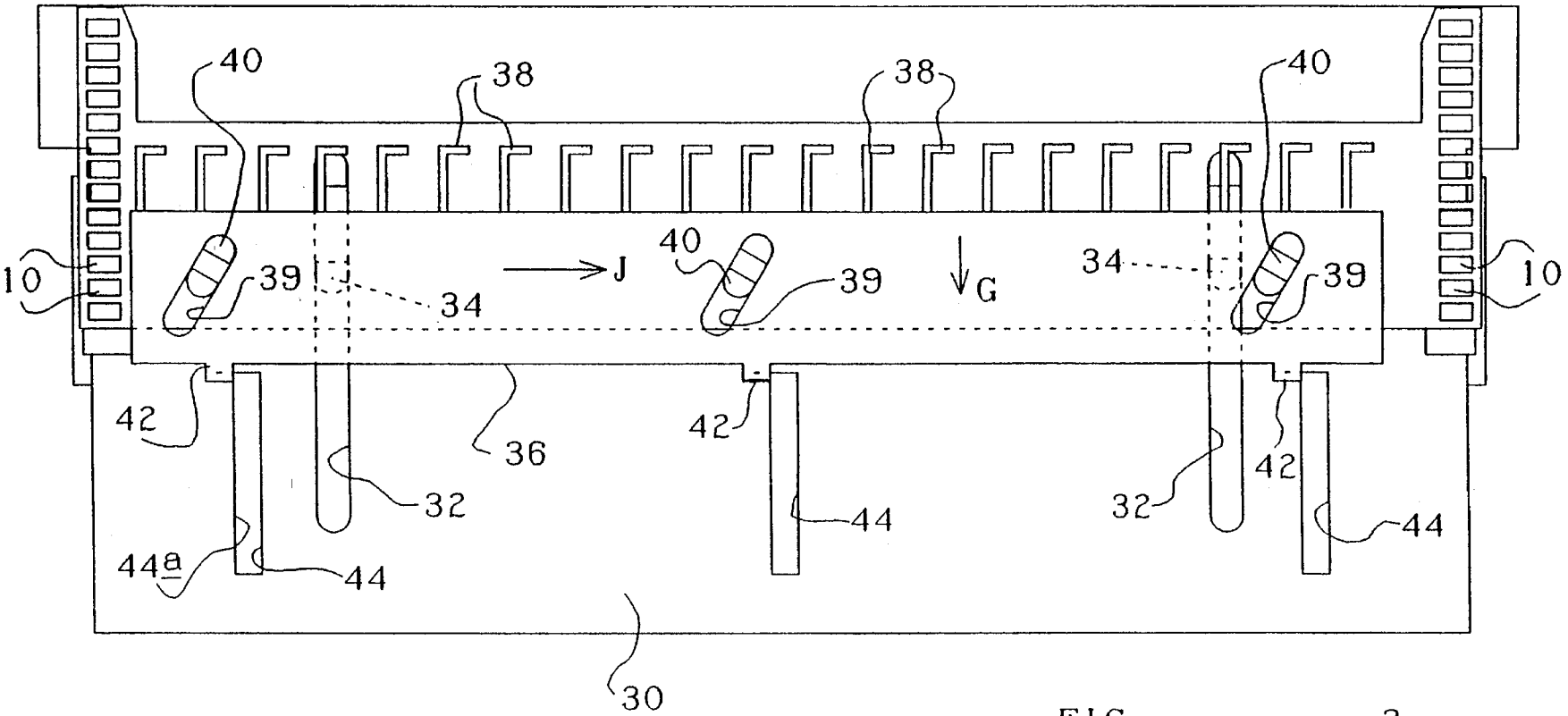
FIGS. 3, 4 and 5 are plan views of the machine, again parts having been removed for clarity, showing elements of the machine in different positions during operation of the machine.

FIGS. 1 and 4 show the drive plate 8 in its rest or retracted position, in engagement with the clamping member 16 and depressing the clamping member 16 against the action of the springs 22, so that the clamping elements 18 are partially withdrawn into the windows 20, as is shown in FIG. 2. In this position, the portion 38*b* of the fingers 38 are located, in a lateral direction, directly in front of adjacent abutments 28 (see also FIG. 6).

In the use of the machine, a binding comb 50 comprising a spine 52 and a series of curved, flexible fingers 54 is inserted into the linear space between the abutments 28 and the retracted clamping elements 18, and a drive operation of the machine is commenced, such as by depression of an operating handle 13, causing the pinions 12 to rotate to move the drive plate 8 in the direction of the arrow G, the rear edge of the drive plate allowing the clamping member 16 to move in the housing 6 and the clamping elements 18 to move towards the abutments 28, clamping the spine 52 of the comb therebetween, the coiled fingers 54 being located laterally between adjacent abutments 28.

Such movement of the drive plate causes the studs 40 to move along the inclined guide slots 39, causing the operating member 36 to move in the direction of the arrow J, as the tangs 42 move within the lateral portion 44*b* of the guide slot 44, causing the portions 38*b* of the fingers to move within the coiled fingers of the binding member (see FIGS. 1 and 8). Further movement of the drive plate 8 causes linear movement of the operating member 30 in the direction of the arrow G, as the tangs 42 move within the portions 44*a* of the guide slots 44, the fingers 38*b* pulling the fingers 54 of the binding comb open (shown in dotted lines in FIG. 1 and in FIG. 9), allowing a stack of sheets 46 to be bound together to be located on the binding member, with the fingers 54 being inserted through the apertures 48 provided adjacent the side edge of the stack. On completion of such mounting the drive member 8 is moved by the pinion in the reverse direction, in the direction of the arrow H, the operating member 36 moving with the drive plate and the fingers 38 of the operating member moving to allow the fingers of the binding member to return to their coiled state, around the side edge of the stack of documentary material. As the tangs 42 engage with the ends of the portion 44*a* of the slots 44, continued movement of the drive plate 8, and engagement of the studs 40 on the side edge of the guide slots 39, causes the operating member 36 to move in the direction K, the tangs 42 moving in the portions 44*b* of the slots 44 as the fingers move from engagement with the fingers of the binding member. On final movement of the operating member in the direction H, it engages the clamping member 16 and moves it rearwardly against the action of the springs 22, causing the clamping elements 18 to withdraw from the abutments 28, allowing the bound pack to be taken from the machine.

Whilst in the preferred embodiment the clamping member 16 is moved forwardly to clamp the spine 52 of a comb against the fixed abutments 38 by the springs 22, if desired the clamping member may be interconnected with the operating member 36 in a manner such that, as the fingers 38 move in the direction J, the plate 29 is engaged by a pin and slot arrangement to cause the clamping members 16 to move forwardly (in the direction A) into clamping positions. On completion of the binding operation, movement of the operating member 36 in the direction K may then physically cause the clamping member 16 to retract, to release the comb for removal.

I claim:

1. In a binding machine for binding packets of sheets having a plurality of apertures adjacent a side edge of the packets, said machine including a binding element having a spine and a plurality of curved, flexible, coilable, binding fingers for insertion in said apertures to bind the sheets into a book-like form, a clamping mechanism for clamping the binding element, and an operating member for uncoiling the binding fingers of the binding element, the improvement comprising:

a) a single drive member for both said clamping mechanism and said operating member and moveable among an inoperative position, a first operative position and a second operative position; and b) drive means for moving said drive member from said inoperative position to said first operative position and causing said clamping mechanism to clamp the binding element, and for moving said drive member from said first operative position to said second operative position and causing said operating member to uncoil the binding fingers of the binding element.

2. The improvement of claim 1, wherein the binding fingers of the binding element are spaced apart at a plurality of spacings, and wherein the clamping mechanism is operative for clamping the binding element at a plurality of spaced positions equal to said spacings.

3. The improvement of claim 1, wherein the clamping mechanism includes a plurality of clamping elements and a spring means; and further comprising a plurality of fixed abutment elements; and wherein said spring means is operative for urging said clamping elements into engagement with said fixed abutment elements.

4. The improvement of claim 1, wherein the operating member includes a plurality of operating fingers initially moveable in a lateral direction to positions in which the operating fingers engage within the binding fingers, and subsequently moveable in a longitudinal direction to positions in which the binding fingers are uncoiled prior to insertion in said apertures.

5. A binding machine for binding packets of sheets having a plurality of apertures adjacent a side edge of the packets, comprising:

a) a housing having a plurality of fixed abutment elements;

b) a binding element having a spine and a plurality of curved, flexible, coilable, binding fingers for insertion in said apertures to bind the sheets into a book-like form;

c) a clamping member having a plurality of clamping elements mounted on the housing for movement between a retracted clamping position, and an advanced clamping position in which the clamping elements are located adjacent the fixed abutment elements;

d) an operating member for uncoiling the binding fingers of the binding element, said operating member having a plurality of operating fingers moveable between a retracted operating position, and an advanced operating position;

e) a single drive member for both said clamping member and said operating member and moveable linearly in a first direction to a rest position, and in a second direction to an advanced drive position;

f) drive means for moving said drive member to said rest position upon which said clamping member is moved to said retracted clamping position, and said operating member is moved to said retracted operating position, said drive means being further operative for moving said drive member to said advanced drive position upon which said clamping member is moved to said advanced clamping position to clamp said binding element, and said operating member is moved to said advanced operating position; and g) said operating fingers being initially moveable in a lateral direction to positions adjacent said binding fingers, and being subsequently moveable in a longitudinal direction to positions in which said binding fingers are uncoiled prior to insertion in said apertures.

6. The binding machine of claim 5, wherein each operating finger includes a longitudinal portion and a transverse portion, each transverse portion being moveable along the lateral direction to engage within a respective binding finger clamped by said clamping member, each transverse portion being moveable along the longitudinal direction to uncoil the respective binding finger.

* * * * *